US008800463B2

(12) United States Patent
Sherer

(10) Patent No.: US 8,800,463 B2
(45) Date of Patent: Aug. 12, 2014

(54) BOAT HULL CONSTRUCTION

(76) Inventor: Myron Sherer, Grosse Pointe Farms, MI (US)

( * ) Notice: Subject to any disclaimer, the term of this patent is extended or adjusted under 35 U.S.C. 154(b) by 121 days.

(21) Appl. No.: 13/183,888

(22) Filed: Jul. 15, 2011

(65) Prior Publication Data

US 2012/0015568 A1 Jan. 19, 2012

Related U.S. Application Data

(60) Provisional application No. 61/364,799, filed on Jul. 15, 2010.

(51) Int. Cl.
*B63B 1/32* (2006.01)
*B63H 5/16* (2006.01)

(52) U.S. Cl.
USPC ..... 114/288; 440/71

(58) Field of Classification Search
USPC ..... 114/61.2, 61.32, 62, 288, 289, 290; 440/66–71
See application file for complete search history.

(56) References Cited

U.S. PATENT DOCUMENTS 1,059,806 A 4/1913 Yarrow
1,505,832 A 8/1924 Weisz
3,793,980 A * 2/1974 Sherman ..... 440/69
4,288,223 A 9/1981 Gonzalez et al.
4,300,889 A 11/1981 Wormser
4,622,016 A 11/1986 Hankley
4,637,801 A 1/1987 Schultz
4,666,411 A 5/1987 Silvester
4,804,312 A 2/1989 Schneekluth
RE33,165 E 2/1990 Whitehead
4,907,520 A 3/1990 Pipkorn
4,932,908 A 6/1990 Larimer et al.
5,203,275 A 4/1993 Brauner et al.
D335,484 S 5/1993 Moyle et al.
D378,813 S 4/1997 Jacques
5,655,473 A * 8/1997 Arvilla ..... 114/61.1
5,890,937 A 4/1999 Granger
5,957,078 A 9/1999 Van Tassel
D416,535 S 11/1999 Rudofsky
6,210,242 B1 * 4/2001 Howard et al. ..... 440/21
6,213,824 B1 4/2001 Small
6,851,991 B2 2/2005 Eriksson
7,318,388 B2 * 1/2008 Scism et al. ..... 114/273

* cited by examiner

*Primary Examiner* — Daniel V Venne
(74) *Attorney, Agent, or Firm* — Harness, Dickey & Pierce, P.L.C.

(57) ABSTRACT

A boat including a propeller tunnel portion formed in a hull of the boat in which a propeller rotates on an output shaft that extends from the propeller tunnel. A protrusion having a curved portion terminates in a tip portion. The protrusion extends from the propeller tunnel portion and the tip portion terminates near the aft plane of the propeller. The placement of the protrusion in the propeller tunnel portion can be shown to improve propulsion efficiency.

17 Claims, 8 Drawing Sheets

BOAT HULL CONSTRUCTION

CROSS-REFERENCE TO RELATED APPLICATIONS

This application claims the benefit of U.S. Provisional Application No. 61/364,799, filed on Jul. 15, 2010. The entire disclosure of the above application is incorporated herein by reference.

FIELD

The present teachings relate to a boat hull construction and more specifically relate to a structure that can be formed around a propeller that provides a propulsive force for a boat.

INTRODUCTION AND SUMMARY

The structure around a propeller of a boat can take the form of a protrusion that can extend from a propeller tunnel portion formed in a hull of an inboard engine boat or a cowling with a similar protrusion that can surround or partially surround a propeller on an outboard motor or inboard-outboard configuration.

The present teachings generally include a boat including a propeller tunnel portion formed in a hull of the boat in which a propeller rotates on an output shaft that extends from the propeller tunnel or hull. A protrusion having a curved portion terminates in a tip portion. The protrusion extends from the propeller tunnel portion and the tip portion terminates near the aft plane of the propeller.

In another aspect, the present teachings provide a boat with a deck on which occupants can travel on water using the propulsive force of a propeller rotated on an output shaft. The boat includes a hull having a first portion forward of a second portion. A surface of the first portion diverges from or is parallel to the deck. A surface of the second portion includes a propeller tunnel portion in which the propeller rotates on the output shaft. The propeller tunnel portion includes a portion that converges toward the deck. A protrusion is provided having a curved portion that terminates in a tip portion. The curved portion diverges from the deck, and the tip portion is disposed near an aft plane of the propeller.

In yet another aspect, the present teachings provide a boat motor including a propeller that rotates on an output shaft. A cowling is provided at least partially around the propeller. The cowling includes a protrusion defining an annular edge having a minimum inner diameter, the annular edge is disposed near the aft plane of the propeller.

Further areas of applicability will become apparent from the description provided herein. The description and specific examples in this summary are intended for purposes of illustration only and are not intended to limit the scope of the present teachings.

DRAWINGS

The drawings described herein are for illustrative purposes only of selected aspects of the present teachings and not all possible implementations, and are not intended to limit the scope of the present teachings.

Corresponding reference numerals indicate corresponding parts throughout the several views of the drawings.

DETAILED DESCRIPTION

Figure 1:
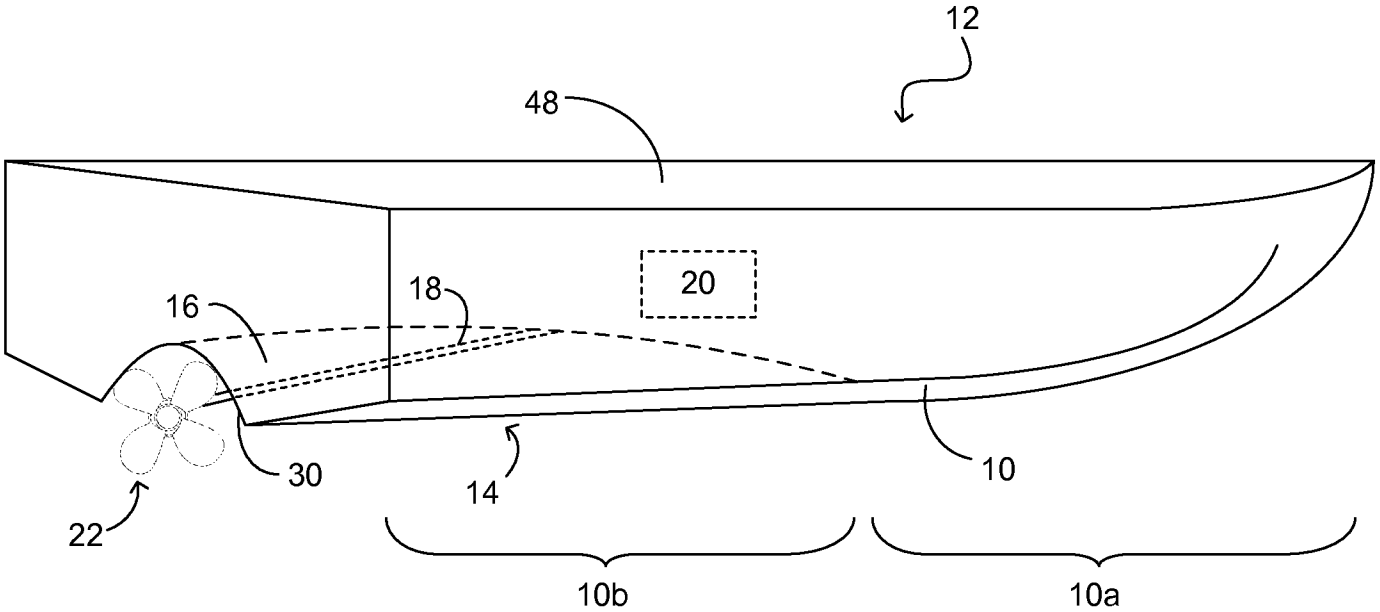
FIG. 1 is a perspective view of a hull of an exemplary boat having a propeller tunnel portion with a protrusion that is partially disposed with an aft plane of a propeller in accordance with the present teachings.

Example aspects of the teachings will now be described more fully with reference to the accompanying drawings.

Example aspects of the teachings are provided so that this disclosure will be thorough, and will fully convey the scope to those who are skilled in the art. Numerous specific details are set forth such as examples of specific components, devices, and methods, to provide a thorough understanding of the aspects of the teachings. It will be apparent to those skilled in the art that specific details need not be employed, that example aspects can be embodied in many different forms and that neither should be construed to limit the scope of the teachings. In some example aspects, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer, or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example aspects.

Spatially relative terms, such as "inner," "outer," "beneath," "below," "lower," "above," "upper," "rearward," "aft," "forward," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
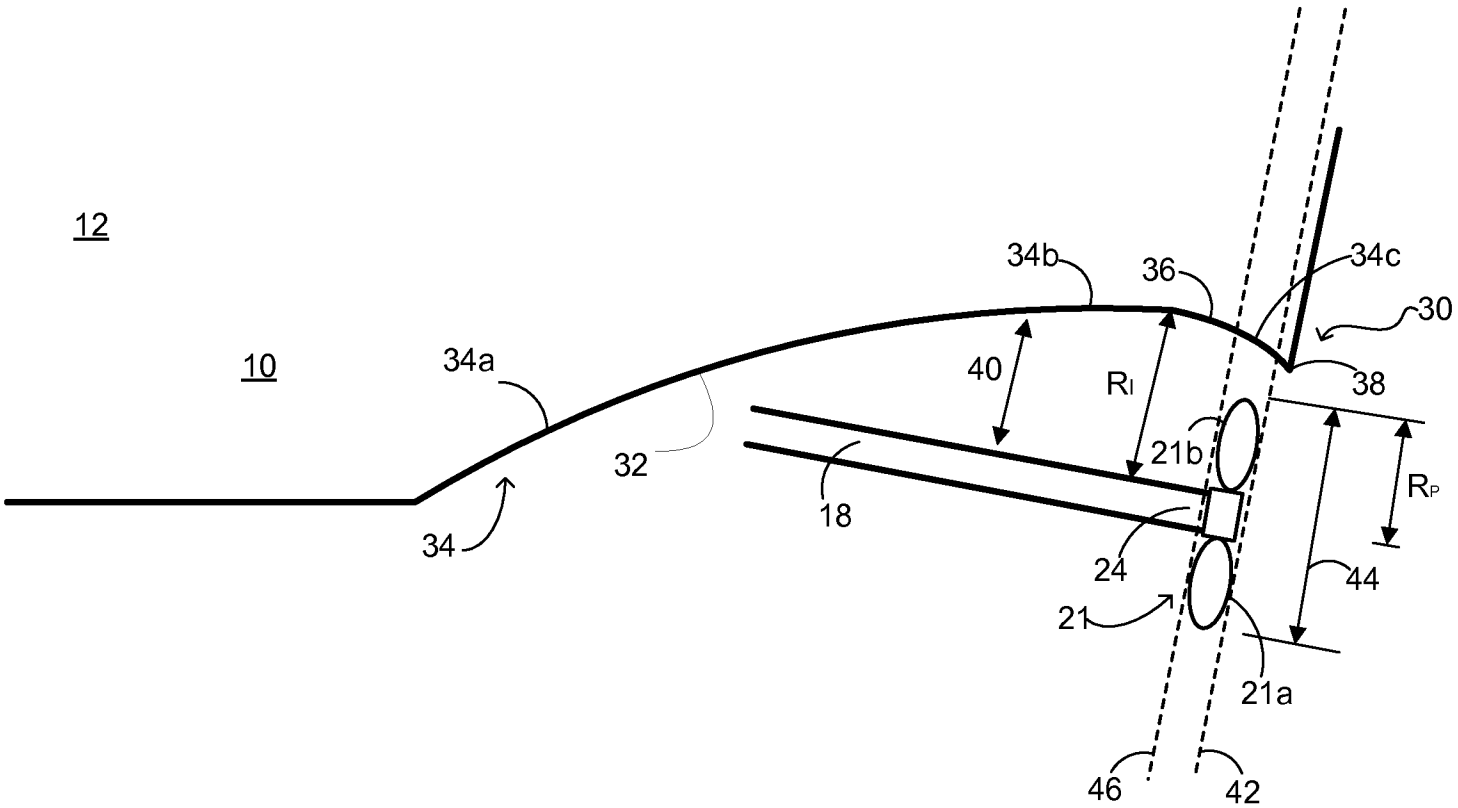
FIG. 2 is a diagram of the propeller tunnel portion showing the protrusion formed with the aft plane of the propeller in accordance with the present teachings.
Figure 3:
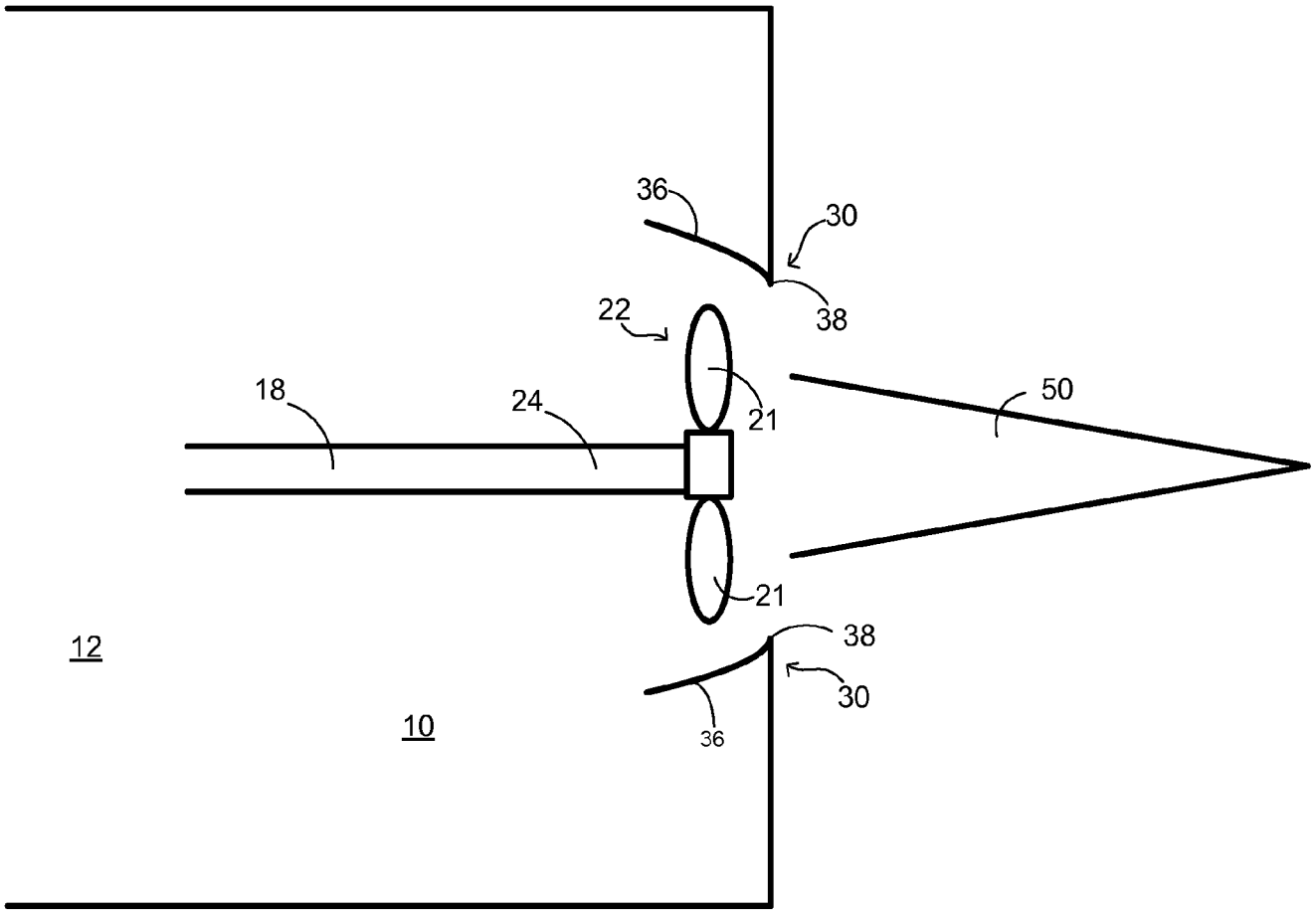
FIG. 3 is a diagram of the propeller and the protrusion showing a conical shape formed rearward of the aft plane of the propeller that may be almost entirely filled with air in accordance with the present teachings.

With reference to FIG. 1, FIG. 2, and FIG. 3, a hull 10 of a boat 12 can include a propeller tunnel portion 14. The propeller tunnel portion 14 can include a surface 16 toward the stern of the boat 12. An output shaft member 18 can extend from the surface 16 and connect to an engine 20 that can be contained within the hull 10 of the boat 12. A propeller 22 can be fixed to an end 24 of the output shaft 18 and can be rotated by the engine 20 to impart a forward velocity on the boat 12. It is envisioned that the propeller tunnel portion 14 can be formed in the hull 10 of a boat 12 during its initial manufacture, or a conventional hull can be modified and adapted as desired.

The propeller tunnel portion 14 can include a protrusion 30 formed on a surface 32. The surface 32 of the propeller tunnel portion 14 can be on the bottom of the hull 10 and adjacent a contoured portion 34 of the propeller tunnel portion 14. The protrusion 30 can have a curved portion 36 that can terminate in a tip portion 38. In various aspects, the protrusion 30 can be fixed to the surface 32, for example, as a permanent and non-movable component fixture. In other aspects, the protrusion 30 is moveable, for example, it can be movably attached to the surface 32 with known fastening means. In this regard, there may be various connection points where the protrusion 30 can be attached. In still other embodiments, the protrusion 30, as well as other features disclosed herein, may be attached to a boat having a more convention hull, for example a hull that does not have a propeller tunnel portion.

With reference to FIG. 2, the curved portion 36 and the tip portion 38 can be configured to reduce a dimension 40 (FIG. 2) along the aft portion of the propeller tunnel portion 14 in a rearward direction between the surface of the propeller tunnel portion 14 and the propeller shaft 18. The smallest value of the dimension 40 can be found near the tip portion 38 and the propeller 22. Examples of the motivation to reduce this dimension 40 are explained below.

In one example, the curved portion 36 of the protrusion 30 inwardly extends a distance from a surface 32 of the propeller tunnel portion 14 can terminate at the tip portion 38 that can be aligned at an aft plane 42 of the propeller 22. The aft plane 42 of the propeller 22 is a plane perpendicular to the output shaft 18 and defined by an aft-most extension 21*a* of the blades 21 of the propeller 22. It will be appreciated in light of the present disclosure that the tip portion 38 can be disposed with the rear plane 42 of the propeller 22 or rearward of the rear plane 42 of the propeller 22. As such, the tip portion 38 can be positioned just outside of an outer diameter 44 of the propeller 22 (i.e., outside of an outer radius—$R_P$). The propeller 22 can also have a forward plane 46. The forward plane 46 of the propeller is a plane perpendicular to the output shaft 18 and defined by a forward-most extension 21*b* of the blades 21 of the propeller 22.

In a further example, the tip portion 38 of the protrusion 30 can also be configured to terminate slightly rearward of the aft plane 42 of the propeller 22 and can also be positioned just inside of the outer diameter 44 of the propeller 22 ($R_P$). With respect to the radial position of the protrusion 30, the curved portion 36 can extend into the spinning outer diameter 44 of the propeller 22 and can at least appear to be similar to a partial converging nozzle or shroud around the propeller 22.

Figure 4:
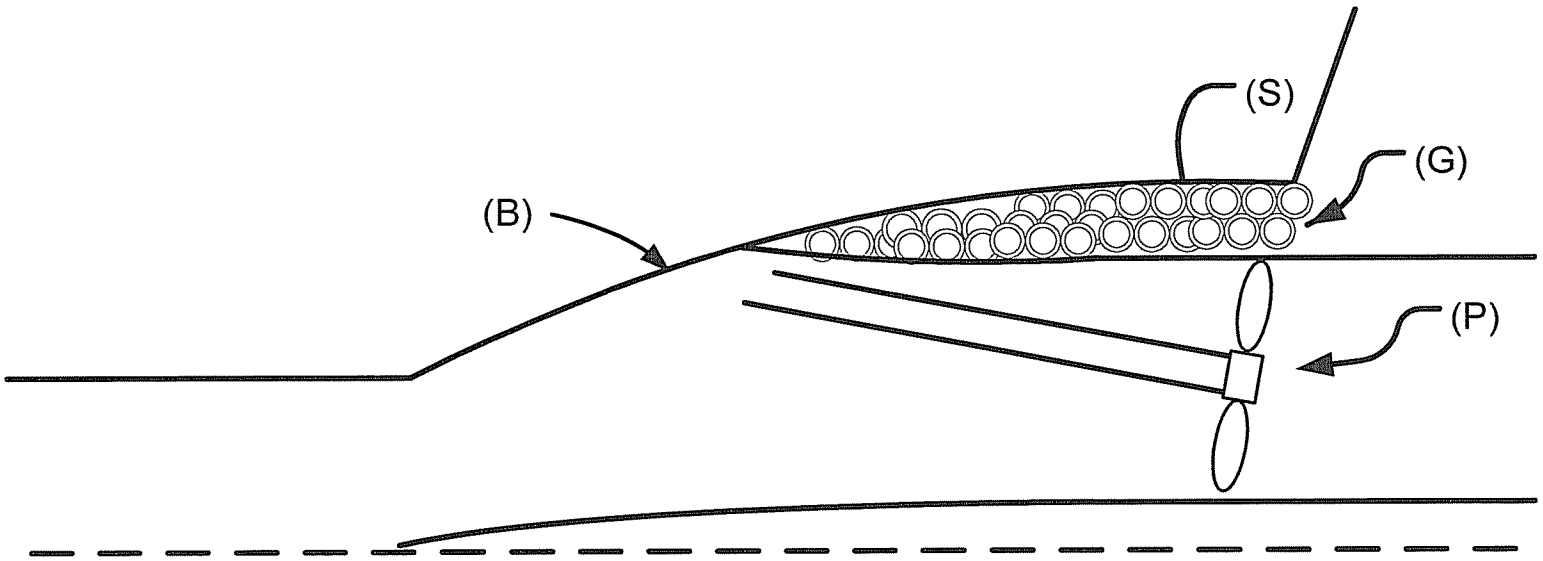
FIG. 4 is a diagram of a conventional boat hull with a propeller tunnel showing less efficient propulsion.

With reference to FIG. 4, it can be shown that as the propeller (P) draws a column of water over the propeller (P), the column of water is stretched as the propeller (P) does work on the column of water. In this regard, the column or this specific cylindrical volume of water can actually reduce in diameter as the column of water is stretched through the propeller (P). As the propeller (P) stretches the water, the diameter of the column of water travelling over the propeller (P) shrinks. Between the shrinking diameter and the flat space (S), the propeller (P) can generate eddy pools and shear forces (G) and can generate a region of low pressure between the flat space (S) and the propeller (P). The creation of the region of low pressure including the possible shear forces and eddy pools (G) can cause a reduction in propulsion efficiency due to, for example, the increased propensity for cavitation to occur.

With reference to FIGS. 1, 2, and 3, it can be shown that by reducing the dimension 40 at the propeller, increases in propulsion efficiency can be achieved. Returning to FIG. 4, the boat hull with the conventional tunnel (B) includes flat space (S) between the propeller (P) and the boat hull (B) where the propeller (P) is mounted in the propeller tunnel. Returning to FIGS. 1, 2, and 3, the protrusion 30 of the present teachings can be disposed in the propeller tunnel portion 14 to reduce the dimension 40 between the surface of the propeller tunnel portion 14 and the propeller 22 and thus generation of the low pressure region at the flat space (S) FIG. 4 is reduced or omitted.

The protrusion 30 in the propeller tunnel portion 14 can essentially curve with the shrinking diameter of the column of water over the propeller 22. The relatively inefficient eddy pools, shear forces and cavitation, as discussed relative to the conventional tunnel (B) in FIG. 4, are not permitted to form or there is less of a propensity for their formation. By doing so, the propeller 22 of the present teachings can more efficiently transform energy into forward motion of the boat 12.

In one example, the propeller tunnel portion 14 can have the contoured portion 34 that can serve as a gradual inflow opening. The contoured portion 34 can expand to a maximum radius i.e., ($R_I$) about the output shaft 18 and forward of the forward plane 46 of the propeller 22. As such, the contoured portion 34 can include an inlet section 34*a* where the contoured area in the propeller tunnel portion 14 gradually increases (i.e., converges toward a deck 48 of the boat 12) and leads to a transition section 34*b* that can include the maximum radius ($R_I$) in the propeller tunnel portion 14. The maximum radius ($R_I$) can be related inversely to the square root of the anticipated slip by the formula below, where $R_P$ is the radius of the propeller 22 and slip is the ratio of the propeller speed of advance divided by the theoretical speed, which is given by the product of shaft rotational velocity and the pitch of the blades of the propeller 22.

$$R_I = \frac{R_P}{\sqrt{slip}}$$

With reference to FIG. 1, the hull 10 may be referred to as having a first portion 10*a* forward of a second portion 10*b*. A surface of the first portion 10*a* of the hull 10 may diverge from or may be parallel to the deck 48. A surface of the second portion 10*b* of the hull 10 may define the propeller tunnel portion 14 in which the propeller 22 rotates on the output shaft 18. With reference to FIG. 1 and FIG. 2, the propeller tunnel portion 14 can converge longitudinally (i.e., away from the deck 48) about the output shaft 18 of the propeller 22 and thus define a converging section that can begin with approximately the maximum radius ($R_I$) at or ahead of the forward edge of the forward plane 46 of the propeller 22 and ending with approximately the radius of the propeller ($R_P$) at the rear edge of the propeller 22, i.e., its aft plane 42. In this regard, the propeller tunnel portion 14 can diverge away from the deck 48. In this arrangement, the discharge stream from the propeller 22 and the space in the area rearward of the aft plane 42 can be open to the surrounding atmosphere.

With reference to FIGS. 2 and 3, when the protrusion 30 is implemented with the hull 10, the propeller 22 can, in one example, produce a cone-shaped zone 50 behind the aft plane 42 of the propeller 22. The cone-shaped zone 50 can be essentially or at least partially devoid of water and extend rearward from the aft plane 42 of the propeller 22. By being devoid of water, the cone-shaped zone can be filled with air. The cone-shaped zone 50 behind the propeller 22 can come into formation when the boat 12 is at (or is approaching) cruise speed. Even in this arrangement, the entire front plane 46 of the propeller 22 can be fully covered by water.

Figure 5:
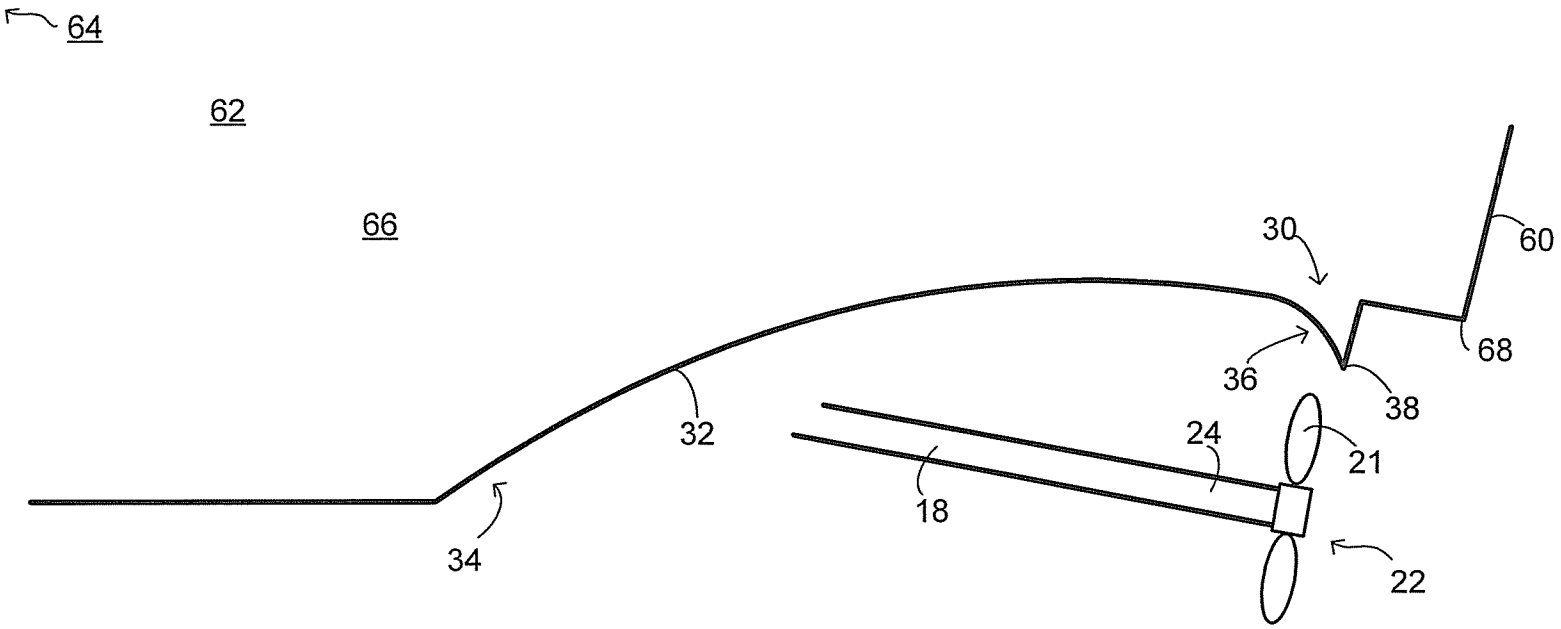
FIG. 5 is a diagram of an alternative boat hull having a protrusion that is formed with the aft plane of the propeller in accordance with the present teachings.

In an additional example and with reference to FIG. 5, the propeller 22 can be positioned inward from a stern 60 (broken line) of a boat 62 in contrast to what is illustrated in FIG. 1. Even though the propeller 22 can be shifted toward a bow 64 of the boat 62, (i.e., moved forward), the protrusion 30 can also be shifted toward the bow 64 of the boat 62 so that the tip portion 38 can be positioned with the aft plane 42 (FIG. 2) of the propeller 22. In this example, a hull 66 of the boat 62 could be configured to direct an airflow 68 toward the aft plane 42 and in the region behind the propeller 22 to further increase efficiency of this arrangement. The source of the airflow 68 could be solely from ducting airflow from forward motion of the boat 62 or could be from a compressed or atmospheric pressure air source resident on the boat 62. Another source for the airflow 68 can be ducted exhaust from the engine 20 (FIG. 1).

Figure 6:
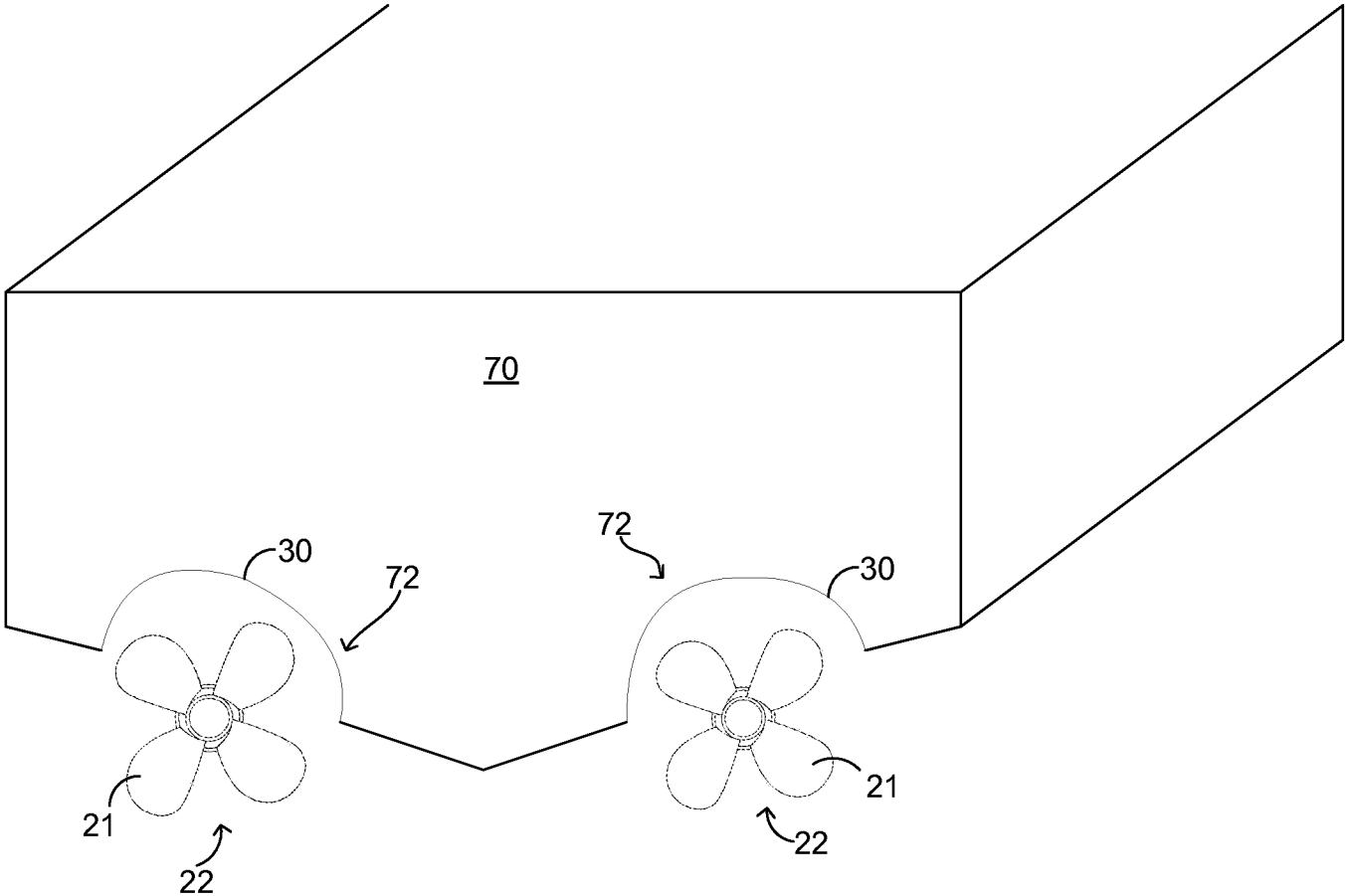
FIG. 6 is a partial perspective view of a hull of a boat having two propellers and protrusions formed in propeller tunnels of each of the propellers in accordance with the present teachings.
Figures 7, 7A:
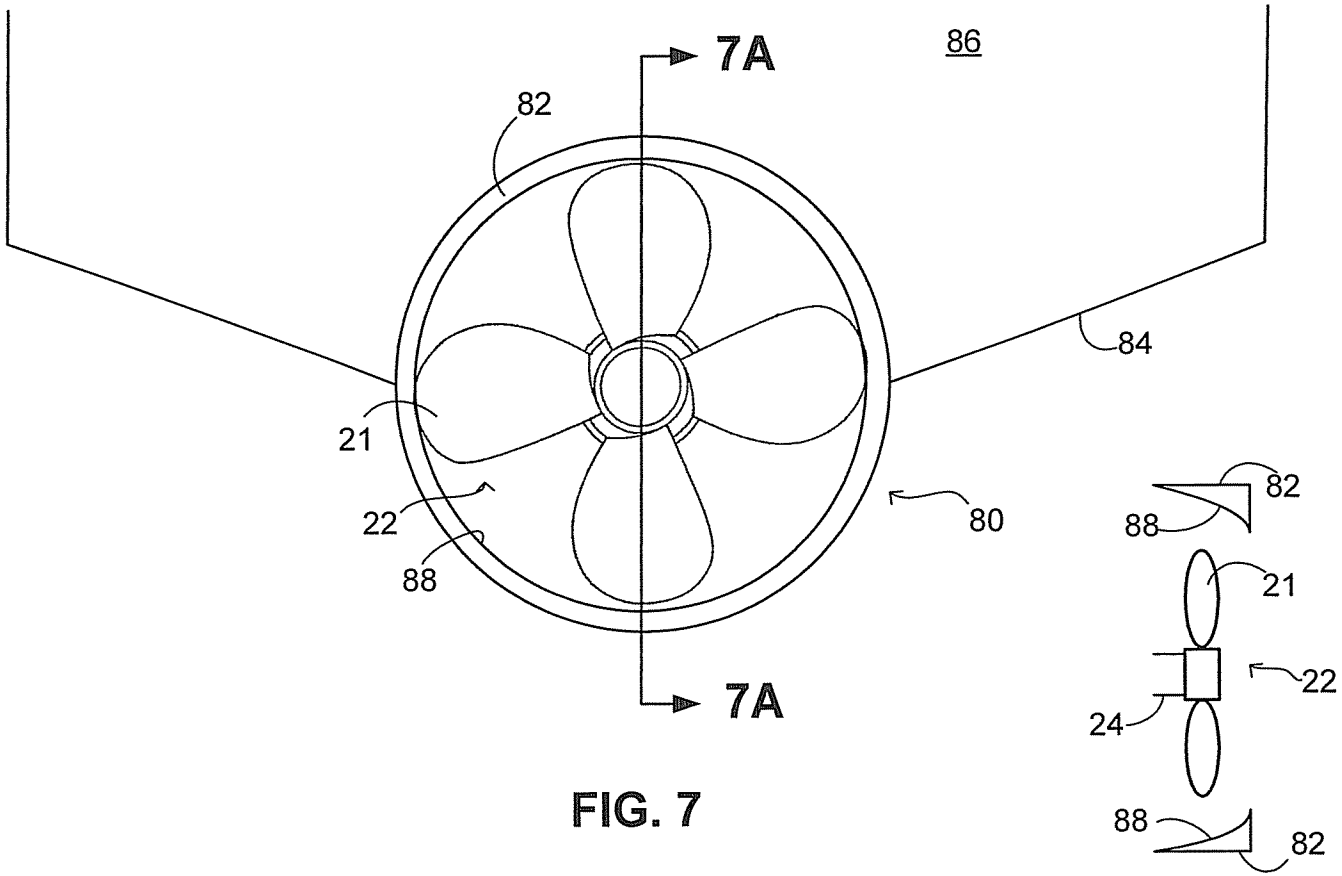
FIG. 7 is a diagram of a hull of a boat having a protrusion that is implemented in a fully annular structure in accordance with the present teachings.
FIG. 7A is a partial cross-sectional view of FIG. 7 taken along the line 7A-7A.

In another example and with reference to FIG. 6, the protrusion 30 as discussed above can be implemented with multiple propellers 22 on a boat 70 having multiple propeller tunnels 72. In yet another example, the protrusion 30, as shown in FIG. 2, can be implemented in a fully annular ring 80, as shown in FIG. 7 and FIG. 7A (a partial cross-sectional view of FIG. 7), such that the protrusion 30 can be formed to provide a cowl all of the way around the propeller 22 to form a 360° structure 82 that can surround the propeller 22. The structure 82 can also partially extend from a bottom 84 of the boat 86. The structure 82 can also partially form an annular structure and therefore be less than 360° . The curved portion 36 and a tip portion 38 can be formed in the same way, but in the fully annular structure. The 360° structure 82 can have an inner annular edge 88 that can have a minimum inner diameter. The inner annular edge 88 can be similarly disposed at or rearward of the aft plane 42 (FIG. 2) of the propeller 22.

It is appreciated in light of the disclosure that the annular structure 82 or a segment thereof can be implemented on an outboard (or inboard/outboard) so that the inner annular edge 88 that can be similarly disposed at or rearward of the aft plane 42 of the propeller 22. In this example, air or exhaust gas may be supplied behind the aft plane 42 of the propeller 22, as is discussed further herein.

Figure 8:
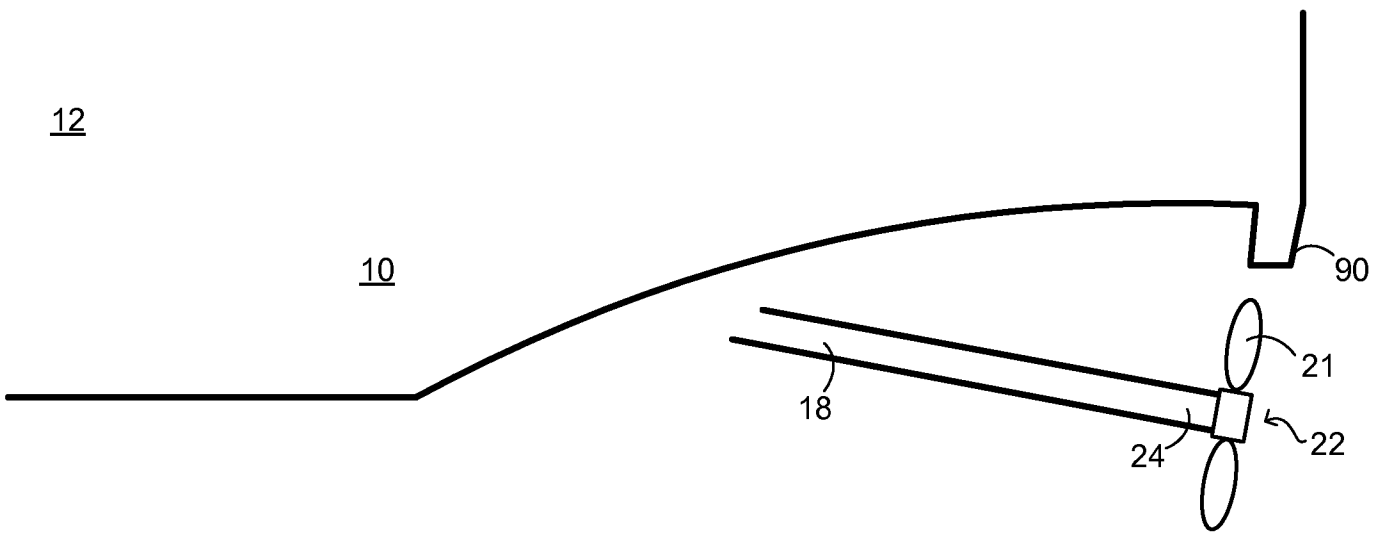
FIG. 8 is a diagram of a hull of a boat having a rectangular protrusion formed with the aft plane of the propeller in accordance with the present teachings.

In another example and with reference to FIG. 8, a rectangular portion 90 can be implemented in the same position as the curved portion 36 and the tip portion 38 of the protrusion 32 that extends from the propeller tunnel portion 14, as shown in FIG. 2.

The foregoing description of the aspects of the present teachings has been provided for purposes of illustration and description. It is not intended to be exhaustive or to limit the teachings. Individual elements or features of a particular aspect are generally not limited to that particular aspect, but, where applicable, are interchangeable and can be used in selected examples, even if not specifically shown or described. The same may also be varied in many ways. Such variations are not to be regarded as a departure from the teachings, and all such modifications are intended to be included within the scope of the present teachings.

What is claimed is:

1. A boat comprising:

a propeller tunnel portion formed in a hull of the boat;

an output shaft extending from said propeller tunnel portion;

a propeller comprising a plurality of blades, said propeller rotating on said output shaft, said propeller defining an outer diameter, a forward plane perpendicular to said output shaft and defined by a forward-most extension of said blades of said propeller, and an aft plane perpendicular to said output shaft and defined by an aft-most extension of said blades of said propeller;

a protrusion having a curved portion that terminates in a tip portion and provides a cowl around at least a portion of said propeller, said protrusion inwardly extends a distance from a surface of said propeller tunnel portion and said tip portion terminates at or abaft said aft plane, and wherein said cowl has an edge disposed at or abaft said aft plane of said propeller, further wherein said propeller tunnel portion defines a contoured portion configured to serve as an inflow opening ahead of said forward plane, wherein said contoured portion defines a maximum radius ($R_I$) according to the formula, $$R_I = \frac{R_P}{\sqrt{\text{slip}}}$$

where ($R_P$) is a radius dimension of said propeller, and (slip) is a ratio of the propeller speed of advance divided by the product of a shaft rotational velocity and a pitch of said propeller.

2. The boat of claim 1 wherein said curved portion defines a surface that longitudinally becomes closer to said output shaft.

3. The boat of claim 1 wherein said curved portion defines a surface that longitudinally becomes closer to said propeller.

4. The boat of claim 1 wherein said propeller tunnel portion converges longitudinally about said output shaft.

5. The boat of claim 1 wherein said protrusion extends from said hull of the boat as an annular structure providing said cowl around an entirety of said propeller, said cowl having an annular edge defining a minimum inner diameter, said annular edge disposed at or abaft said aft plane of said propeller.

6. The boat of claim 1 further comprising a second propeller tunnel portion formed in said hull of the boat in which a second propeller rotates on an output shaft that extends from said second propeller tunnel portion, said second propeller comprising a plurality of blades and defining an outer diameter, a forward plane perpendicular to said output shaft and defined by a forward-most extension of said blades of said propeller, and an aft plane perpendicular to said output shaft and defined by an aft-most extension of said blades of said propeller; and a second protrusion having a curved portion that terminates in a tip portion, said second protrusion inwardly extends a distance from a surface of said second propeller tunnel portion and said tip portion of said second protrusion terminates at or abaft said aft plane of said second propeller.

7. The boat of claim 1 wherein said protrusion produces a cone-shaped zone rearward of said aft plane of said propeller, said cone-shaped zone contains air and is partly devoid of water.

8. The boat of claim 1 wherein said protrusion is fixed to said propeller tunnel portion.

9. A boat with a deck on which occupants can travel on water using the propulsive force of a propeller rotated on an output shaft, the boat comprising:

a hull having a first portion forward of a second portion;

a surface of said first portion that diverges from or is parallel to the deck;

a surface of said second portion defines a propeller tunnel portion in which the propeller rotates on the output shaft, said propeller tunnel portion includes a portion that converges toward the deck;

a protrusion inwardly extending a distance from a surface of said propeller tunnel portion and having a curved portion that terminates in a tip portion and provides a cowl around at least a portion of said propeller, said curved portion diverges from the deck, wherein the propeller comprises a plurality of blades and defines a forward plane perpendicular to the output shaft and defined by a forward-most extension of said blades of the propeller, and an aft plane perpendicular to the output shaft and defined by an aft-most extension of said blades of the propeller, wherein said tip portion is disposed at or abaft said aft plane of the propeller.

10. The boat of claim 4 wherein said propeller tunnel portion defines a contoured portion having an inlet section, a transition section, and a converging section.

11. The boat of claim 10 wherein said contoured portion defines a maximum radius at or ahead of said forward plane.

12. The boat of claim 1 wherein said tip portion terminates at a position rearward of said aft plane.

13. The boat of claim 12 wherein said tip portion terminates at a position outside of said outer diameter of said propeller.

14. The boat of claim 12 wherein said tip portion terminates at a position inside of said outer diameter of said propeller.

15. The boat of claim 1 wherein said tip portion is longitudinally aligned with said aft plane.

16. The boat of claim 1 wherein an entirety of said forward plane of said propeller is configured to be fully covered by water.

17. The boat of claim 9, wherein said propeller tunnel portion defines a contoured portion configured to serve as an inflow opening, wherein said contoured portion defines a maximum radius ($R_I$) according to the formula, $$R_I = \frac{R_P}{\sqrt{\text{slip}}}$$

where ($R_P$) is a radius dimension of said propeller, and (slip) is a ratio of the propeller speed of advance divided by the product of a shaft rotational velocity and a pitch of said propeller.

* * * * *